United States Patent [19]

Bahm

[11] Patent Number: 4,699,346

[45] Date of Patent: Oct. 13, 1987

[54] COLLAPSIBLE FLOW CONTROL EASEL

[76] Inventor: Glenn A. Bahm, 14714 F. Perthshire, Houston, Tex. 77079

[21] Appl. No.: 860,114

[22] Filed: May 6, 1986

[51] Int. Cl.[4] ..... A47G 1/24

[52] U.S. Cl. ..... 248/454; 108/90; 248/456

[58] Field of Search ..... 248/454, 455, 456, 457, 248/447, 447.1, 167; 403/407.1, 353; 108/90, 97, 13

[56] References Cited

U.S. PATENT DOCUMENTS

| | | | |
|---|---|---|---|
| 3,623,691 | 11/1971 | Albee | 248/454 |
| 3,899,164 | 8/1975 | Newman | 248/454 X |
| 4,163,539 | 8/1979 | Awofolu | 248/457 X |
| 4,546,942 | 10/1985 | Winchel | 248/187 |
| 4,570,887 | 2/1986 | Banister | 248/187 |
| 4,582,285 | 4/1986 | Bello | 248/454 X |

*Primary Examiner*—Ramon O. Ramirez

*Attorney, Agent, or Firm*—Schmidt, Johnson, Hovey & Williams

[57] ABSTRACT

A collapsible flow control art easel comprises a base plate which is mounted on the under-side of an art board and which includes spaced apart apertures. A retaining plate mounted on a tripod such as the type commonly used by photographers has two spaced apart guide members with lips that interlock with rims of the base plate adjacent the apertures. The retaining plate also carries a pivotal lever arm having a flange movable into and over a rim of a third aperture of the base plate, in order to releasably lock the base plate to the retaining plate. The guide members have exterior, laterally converging guide surfaces which engage converging lateral rims of the base plate for aligning the latter to the retaining plate. A multi-pivotal support assembly, including the tripod, enables movement of the base plate and the art board carried thereon in a path defined by a reference line extending transversely through the base plate and sweeping an imaginery, inverted cone.

11 Claims, 7 Drawing Figures

COLLAPSIBLE FLOW CONTROL EASEL

BACKGROUND OF THE INVENTION

1. Field of the Invention

The present invention generally relates to a collapsible art easel and is more particularly concerned with an easel having a pivotal support assembly for enabling manual maneuvering of an art board in a path perpendicular to a reference line sweeping an inverted cone. A self-aligning attachment and release mechanism in the form of two interlocking plates detachably connects a retaining plate comprising part of the multi-pivotal support assembly to the underside of a base plate which in turn supports the art board.

2. Description of the Prior Art

In water color painting, there has been an increasing demand for easels adapted to control the flow of washes in all directions, and for easels which are more stable and easier to transport.

Prior art easels were often constructed to support the art board at a selected angle, and flow control of washes was generally limited to one direction. To facilitate multi-directional flows, the art board was usually removed from such easels or was often repositioned, proving disadvantageous.

Easels having art board carriages are often unstable due to an excess amount of leverage imposed on the carriage arm, an unbalanced weight distribution, as well as the amount of stress which is exerted on a single clamping screw. As a result, the artist must frequently steady the art board while painting.

Other types of easels, while being relatively stable, are complex and require extensive time for set-up after being transported.

SUMMARY OF THE INVENTION

Accordingly, it is an important object of the present invention to provide an easel that is stable, yet collapsible, and simplified over known construction in that the art board is a structural component of the easel itself.

Another object of the invention is to provide an easel with a multi-directional flow control means for washes which can be activated by a continuous manual maneuvering of an art board that is movable in a free-floating manner, yet which is pivotally connected to a stable support, resulting in more effective control of the wash.

Another object of the invention is to provide an easel which is light in weight, of relatively simple, more economic construction yet which is more functional than known devices for its intended purposess.

Another object of the invention is to provide an easel which utilizes a standard photographic tripod to pivotally support the art board with only minor adaptations.

Other objects and advantages of the invention will become more apparent from the following description and the accompanying drawings.

In carrying out the invention, flow control of washes is provided by continuous manual maneuvering of the art board by means of the pivotal support assembly in a path wherein the art board is perpendicular to a reference line sweeping an inverted cone.

In accordance with the present invention, an interlocking plate assembly is mounted to the underside center of the art board and is attached to the topside center of the multi-pivotal support assembly resulting in a centrally balanced arrangement with equal weight distribution of the component parts in order to facilitate free-floating movement of the art board.

In one embodiment of the invention, the points of attachment for the releasable easel component are plates having large contact surfaces with spaced apart interlocking members positioned in transverse relationship. As such, stability of the easel is substantially improved and yet the easel can be readily, instantaneously collapsed. The interlocking plate assembly presents a thin profile resulting in space-saving compactness for easier use, transport and storage.

Attachment of the art board to the easel is achieved by means of a self-aligning attachment and release mechanism wherein a retaining plate connected to the tripod has guide members with lips located on leading edges of the members. Converging lateral edges disposed on the members guide the lips under a rim of the base plate for retaining proximal regions of the retaining plate to the base plate. Opposite regions of the retaining plate remote from the guide members are detachably secured to the base plate by a lever arm mounted on the retaining plate and movable to a position to wedge a flange beneath another rim of the base plate, in order to clamp the retaining plate to the base plate in a nonrotatable, stable union.

To prevent accidental collapse of the easel, the lever arm is forceably held in a locked position by a bend in a spring plate which rests in a recess of the lever arm. The spring plate is mounted on an adapter plate which is coupled to the retaining plate.

Release or collapse of the easel is achieved by manually swinging the lever arm to disengage the bend of the spring plate from the recess located on one end of the lever arm and simultaneously disengage an opposite end of the lever arm carrying the wedged flange from the rim of the base plate, enabling almost instant separation of the plates.

In another embodiment of the invention, the adapter plate is retained on the multi-pivotal support assembly by a clamping screw releasably mounted in a female, threaded bore of the adapter plate.

DETAILED DESCRIPTION OF THE DRAWINGS

Figure 1:
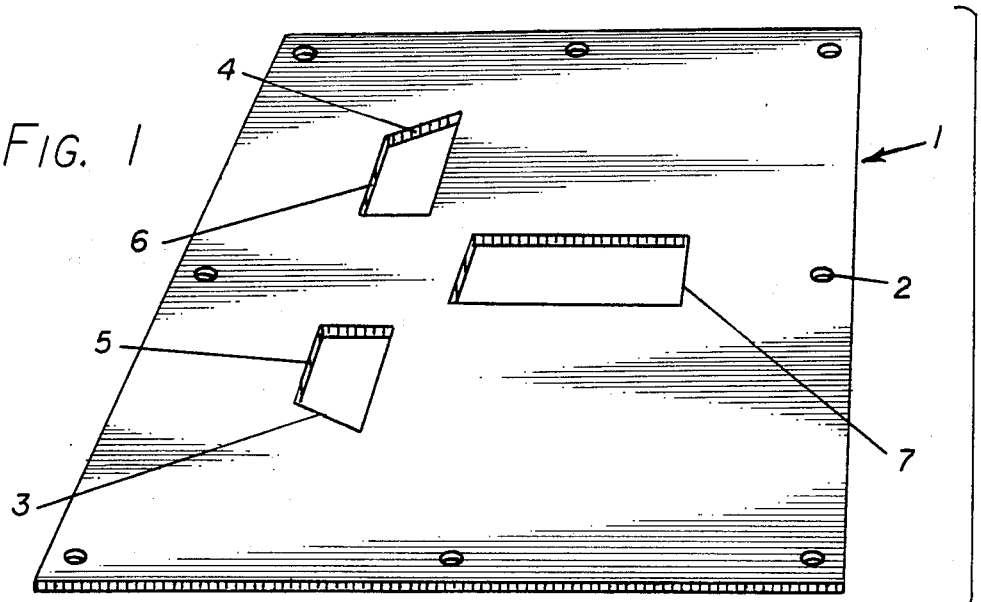
FIG. 1 is a perspective view of a base plate of the collapsible flow control easel of the present invention, shown in exploded relationship to a retaining plate illustrated in FIG. 2 and a pivotal support assembly which is shown in FIG. 3.
Figure 2:
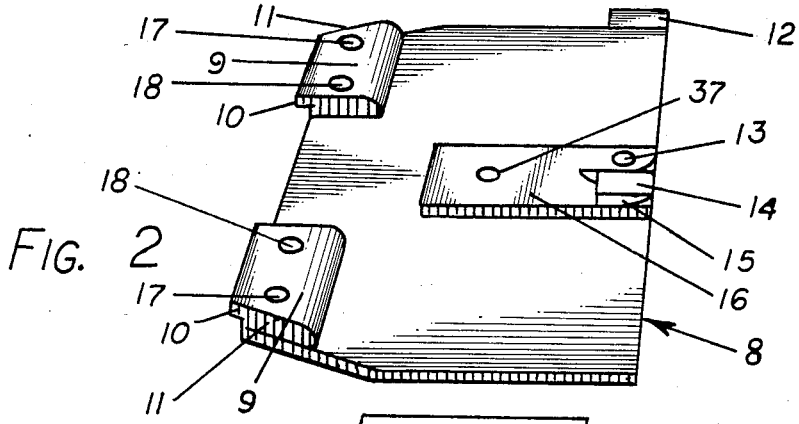
FIG. 2 is a perspective view of the retaining plate shown in exploded relationship to the base plate of FIG. 1 and the multi-pivotal support assembly of FIG. 3.
Figure 3:
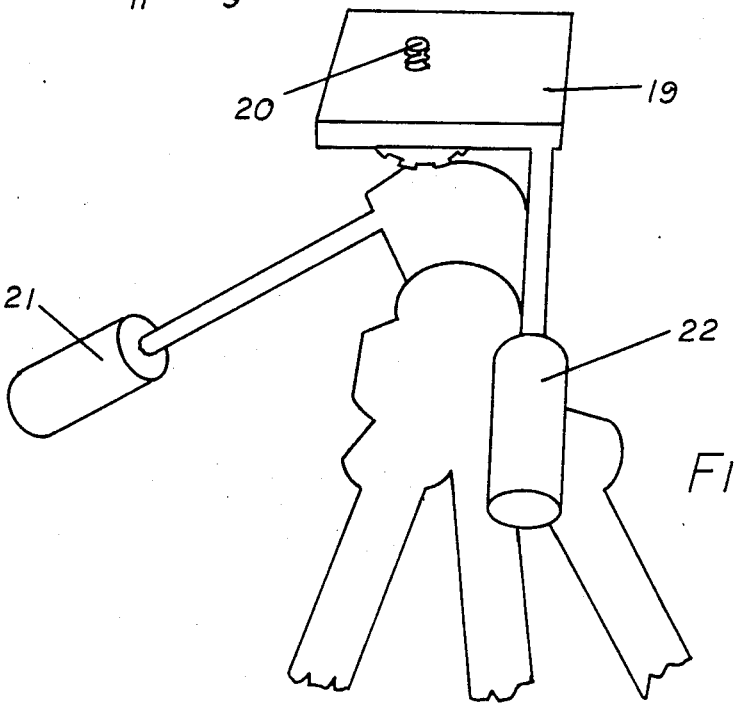
FIG. 3 is a fragmentary, perspective view of the pivotal support assembly shown in exploded relationship to the base plate of FIG. 1 and the retaining plate of FIG. 2.
Figure 4:
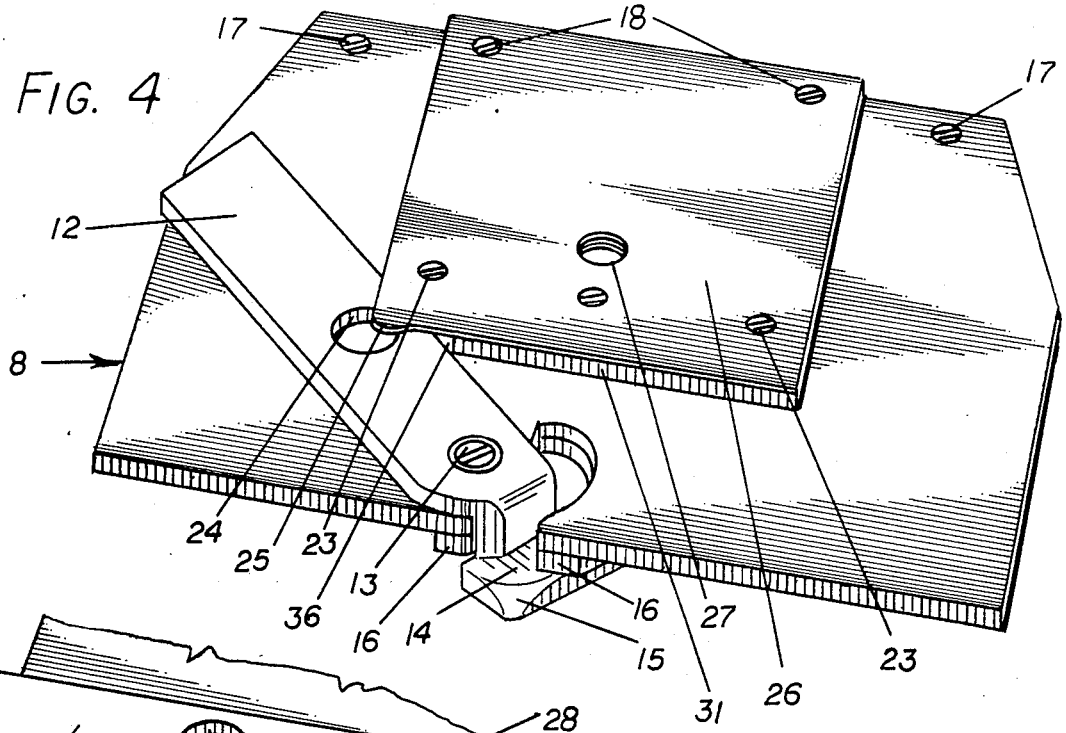
FIG. 4 is an enlarged, perspective view of the underside of the retaining plate illustrated in FIG. 2 with a lever arm being shown in a locked position.
Figure 5:
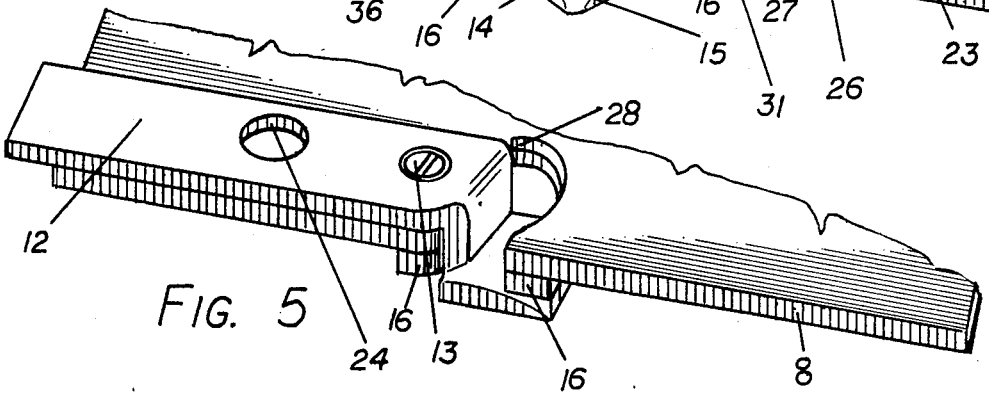
FIG. 5 is a fragmentary view somewhat similar to FIG. 4 except that the lever arm is shown in its release position.
Figure 6:
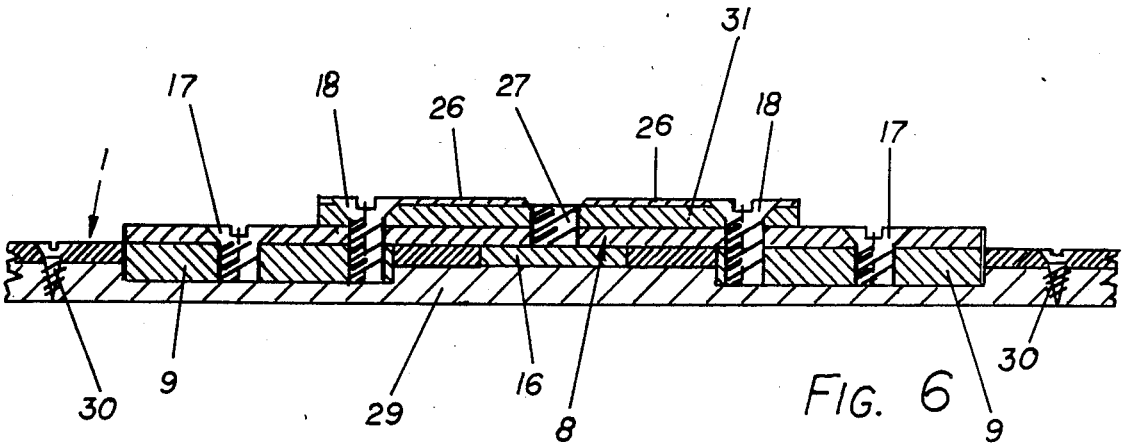
FIG. 6 is a fragmentary, side cross-sectional view illustrating, in inverse relationship, the retaining plate, the base plate and an art board fixed to the base plate when the components are assembled for use.
Figure 7:
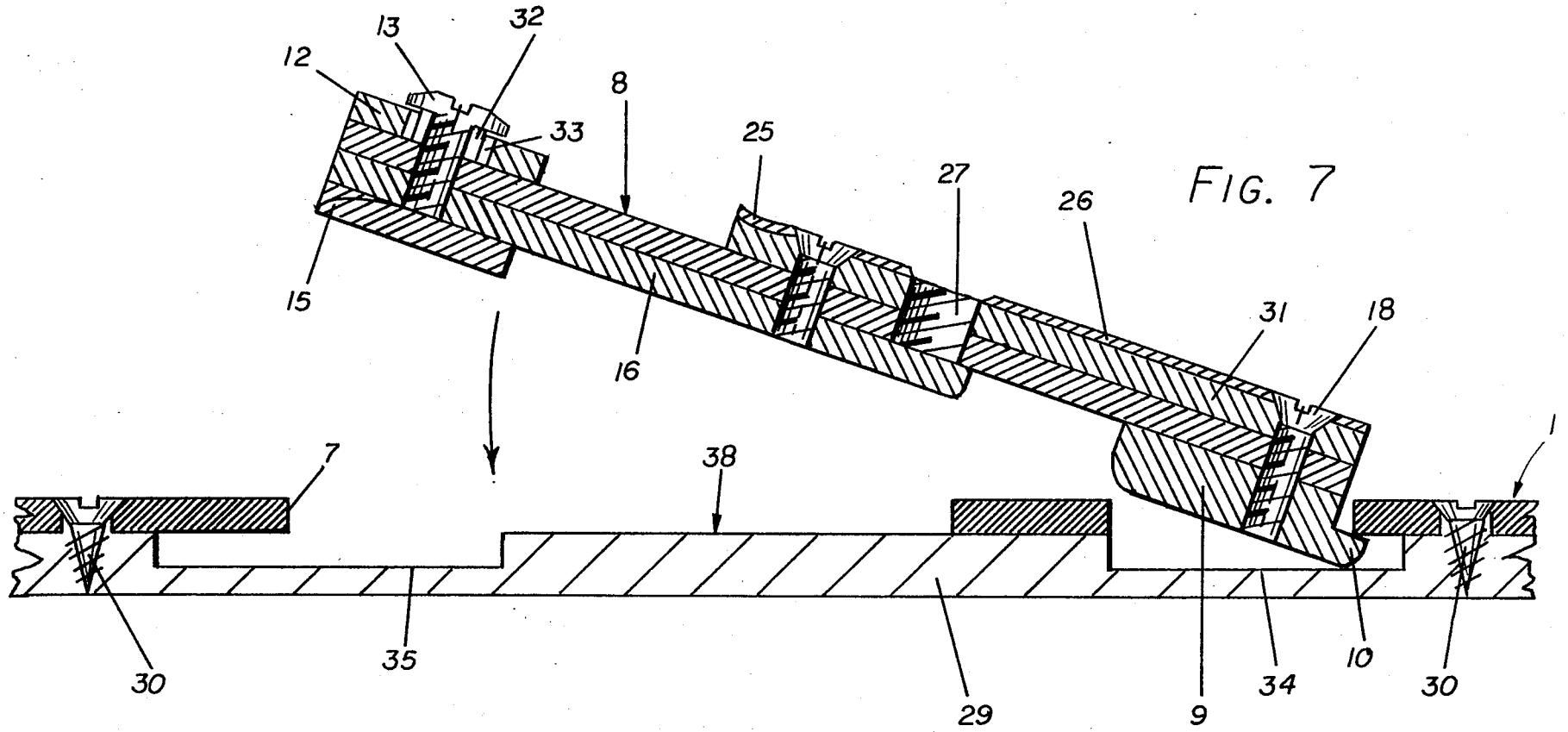
FIG. 7 is an enlarged, fragmentary, end cross-sectional view transverse to the side shown in FIG. 6 and illustrating the manner in which lips of guide members of the retaining plate hook over a rim of the base plate as the retaining plate is moved to a position to interlockingly connect with the base plate.

The collapsible flow control easel of the present invention is shown in FIGS. 1–7 and broadly includes a base plate 1, a retaining plate 8 and a multi-pivotal support assembly, which are shown in FIGS. 1–3 respectively. The base plate 1 releasably supports an art board 29 by means of screws 30 which extend through holes 2 (FIG. 1) in the base plate 1 and into the art board 29, as is shown in FIGS. 6 and 7.

Referring to FIG. 1, the base plate 1 is provided with structrue defining two spaced apertures which present two generally aligned, interior rims 5–6 respectively as well as two interior, side rims 3, 4 which are disposed laterally to rims 5, 6 and which converge toward each other. Structure defining a third, generally rectangular aperture in the base plate 1 presents a rim 7 that is remote from rims 3–6.

Retaining plate 8, as shown in FIG. 2, carries two spaced guide members thereabove which are fixed to the retaining plate 8 by means of bolts 17, 18 (see also FIG. 6). As illustrated in FIGS. 2 and 4, two corner regions of the retaining plate 8 present inwardly tapering edges that are in general alignment with exterior converging lateral surfaces 11 of respective guide members 9 (FIG. 2).

A member 16, mounted atop the retaining plate 8, is fixed to the latter by means of a bolt 37 (see FIG. 2). An adapter plate 31 is mounted on the opposite or bottom side of retaining plate 8, and a spring plate 26 contacts a bottom side of the adapter plate 31 as can be appreciated by reference to FIG. 4. Bolts 23 are provided to connect one end of the spring plate 26 and the adapter plate 31 to the retaining plate 8, while bolts 18 connect an opposite end of the spring plate 26 and adapter plate 31 to retaining plate 8 as well as guide members 9 (see also FIGS. 2 and 6).

A lever arm 12, as illustrated in FIGS. 4, 5 and 7, is pivotally connected to the retaining plate 8 by means of a screw 13. In order to ensure free rotation of lever arm 12, screw 13 is received within an inner sleeve 32 (FIG. 7) which in turn is disposed within an outer sleeve 33 that is received within a hole of the lever arm 12.

As lever arm 12 is moved from a release position shown in FIG. 5 to a locking position as illustrated in FIG. 4, a bend 25 (see also FIG. 7) located in one corner of the spring plate 26 shifts to a position within a recess 24 disposed in one end of the lever arm 12 to retain the latter in its locking position. A second end of the lever arm remote from the end provided with recess 24 extends transversely through an opening in the retaining plate 8 and carries thereabove a flange 14 which extends past the top of member 16 and which is formed to present a wedged portion 15 (FIGS. 2 and 4).

A pivotal support assembly for supporting art board 29 comprises adapter plate 31 as well as a tripod which is shown in FIG. 3 and which preferably takes the form of a conventional, photographic tripod. The tripod presents a relatively large surface contact area 19 through which extends a clamping screw 20, the latter of which can be received within a female threaded bore 27 of the adapter plate 31 (see FIG. 4). Knobs 21, 22 of the tripod can be loosened to enable free-floating movement of the contact area 19 in any one of a number of directions.

In use of the collapsible flow control easel of the present invention, transverse directional knobs 21, 22 are tightened to immobilize the contact area 19. Next, clamping screw 20 is received within threaded bore 27 of adapter plate 31 and turned to bring the contact area 19 into engagement with the spring plate 26 of retaining plate 8.

Next, base plate 1, coupled to art board 29, is moved in such a fashion to shift lips 10 through the two apertures in the base plate 1 and into a bore 34 (FIG. 7) formed in the art board 29. As guide members 9 move through complemental apertures and into respective bores 34, lips 10 embrace corresponding rims 5, 6 of the base plate 1, while simultaneously the exterior converging lateral surfaces 11 of the members 9 are guided by the converging, lateral rims 3, 4 of the base plate 1 in order to bring the latter into predefined alignment with the retaining plate 8.

Further movement of the base plate 1 toward the retaining plate 8 causes member 16 as well as flange 14 to shift within the third, complemental aperture of the base plate 1 which is identified by the numeral 38 in FIG. 7 until the base plate 1, along with art board 29 are in parallel relationship to a reference plane and to each other as is depicted in FIG. 6. The flange 14 of lever arm 12 is then shifted within bore 35 (FIG. 7) provided in the artboard 29 in order to bring flange 14 over rim 7 of base plate 1. The wedge shaped portion 15 of flange 14 facilitates movement of the flange 14 into snug retention with rim 7.

Bend 25 of spring plate 26 releasably retains the lever arm 12 in its locked position to ensure that flange 14 remains in contact with rim 7 of base plate 1. Adapter plate 31 is of a generally rectangular shape although one corner 36 (FIG. 4) is beveled to accomodate movement of the lever arm 12 toward its locking position.

When the base plate 1 is in interlocking, parallel relationship with retaining plate 8 and lever arm 12 is shifted to its locking position shown in FIG. 4, all component parts of the easel, including spring plate 26, adapter plate 31, retaining plate 8, base plate 1 and art board 29 form a stable, immobile plate assembly. By unbinding the transverse directional knobs 21, 22 of the tripod shown in FIG. 3, a free-floating motion of the art board 29 can be affected whereby the art board 29 is anchored to a fixed point but is pivotally mobile. The allowable motion of the manually maneuverable artboard 29, when the transverse directional knobs 21, 22 are untightened, is about and within a path that is defined by an imaginary line extending transversely through the base plate 1 and the retaining plate 8 and sweeping the periphery of an imaginary, inverted cone, as is provided by the motion of conventional photographic tripods.

In order to release the retaining plate 8 secured to the tripod from the base plate 1 which is secured to art board 29, lever arm 12 is forceably rotated away from abutment 36 (FIG. 4) to disengage bend 25 of the spring plate 26 from the recess 24 of lever arm 12. Simultaneously, movement of the lever arm 12 away from abutment 36 causes flange 14 to be released from its wedged position above rim 7. Once the lever arm 12 is in its release position as depicted in FIG. 5, lever arm 12 is parallel with the edge of retaining plate 8 and is retained in such disposition by means of an abutment 28.

The disclosure of the invention described herein represents the preferred embodiments of the invention; however, variations thereof, in the form, construction, and arrangement of the various components thereof and the modified application of the invention are possible without departing from the spirit and scope of the appended claims.

What is claimed is:

1. A collapsible flow control easel comprising:

a pivotal support assembly having a clamping screw;

a base plate having a first end and a second end, said base plate including structure defining internal rims, corresponding converging lateral edges on said rims, and apertures adjacent to said rims, said base plate adapted to be mounted to the underside center of an art board;

a retaining plate having a first planar side and a second planar side, said plate having interlocking members positioned in transverse configuration thereon, said members having exterior converging lateral edges, said retaining plate adapted to be mounted to said pivotal support assembly on the first planar side and adapted to effect a general meshing contact with the base plate on the second planar side when urged into alignment with said base plate by said corresponding converging lateral edges on the internal rims of the base plate apertures and on the exterior convering lateral edges on said interlocking members of said retaining plate, said interlocking members having lips for connecting said retaining plate to said base plate, said lips being slidable linearly under said internal rims of the base plate apertures on the first end; an arm pivotally connected to said retaining plate and being adapted to shift to a locked, wedged position under one of said internal rims of the base plate aperture on the second end; an adapter plate mounted on said retaining plate, said arm, when in locked position, laterally abutting said adapter plate in adjacent relation thereto, said arm having a recess; and a spring plate having a bend engageable with said recess of said arm, said spring plate being mounted on said adapter plate, said adapter plate including a female thread thereon to receive said clamping screw of said pivotal support assembly, said pivotal support assembly comprising a planar surface attached to a multi-pivotal axis with a binding and unbinding means, for effecting a general conicle motion of the art board with its vertex terminating in the pivotal axis, said assembly including a stationary support and said pivotal axis being mounted on said stationary support.

2. A collapsible flow control easel as claimed in claim 1, wherein a photographic tripod is utilized as said pivotal support assembly.

3. In an easel system having an art board and a support assembly, low profile means for releasably securing said art board to said support assembly comprising:

base plate means connected to said art board;

retaining plate means coupled to said support assembly and engageable with said base plate means for positioning the latter along a selected reference plane;

a pair of spaced members connected to one of said base plate means and said retaining plate means;

structure connected to the other of said base plate means and said retaining plate means and defining a pair of spaced apertures each having a configuration complemental to the configuration of one of said members in a direction transverse to said reference plane, said members being insertable within respective apertures in a direction generally transverse to said reference plane, with said members and said complemental apertures thereafter substantially precluding relative rotation between said base plate means and said retaining plate means about an axis perpendicular to said reference plane; and flange means connected to one of said base plate means and said retaining plate means and selectively shiftable to engage the other of said base plate means and said retaining plate means for releasably locking said base plate means to said retaining plate means while said guide members and said structure preclude relative rotation between the same.

4. The invention as set forth in claim 3, wherein at least one of said members is provided with lip means extending in a direction generally parallel to said reference plane for contacting said structure in overlapped relation thereto as said members are inserted within said apertures.

5. The invention as set forth in claim 4, wherein said members have guiding edges extending in a direction parallel to said reference plane and converging toward each other.

6. The invention as set forth in claim 5; including a third member coupled to one of said base plate means and said retaining plate means; and structure defining a third aperture coupled to the other of said base plate means and said retaining plate means, and wherein said flange means is disposed adjacent one of said members, is insertable within one of said apertures along with said one, adjacent member, and is shiftable to a position to engage said structure in overlapped relation thereto for releasably locking said base plate means to said retaining plate means.

7. The invention as set forth in claim 3, wherein said flange means is disposed adjacent one of said members, is insertable within one of said apertures along with said one, adjacent member, and is shiftable to a position to engage said structure in overlapped relation thereto.

8. The invention as set forth in claim 7, wherein said flange means includes a wedging portion.

9. The invention as set forth in claim 8, including means yieldably retaining said flange means in said position.

10. The invention as set forth in claim 3, wherein said support assembly includes means for enabling selective movement of said art board along a path transverse to a line sweeping an imaginary, inverted cone.

11. The invention as set forth in claim 9; including a screw for clamping said retaining plate means to said support assembly.

* * * * *